US007993502B2

(12) United States Patent
Huang

(10) Patent No.: US 7,993,502 B2
(45) Date of Patent: Aug. 9, 2011

(54) COAXIAL SYMMETRICAL COMPLETELY OPEN ELECTROLYTIC BATH

(75) Inventor: Ping Huang, Tainan Hsien (TW)

(73) Assignee: Hung Hsing Electric Co., Ltd., Tainan Hsien (TW)

( * ) Notice: Subject to any disclaimer, the term of this patent is extended or adjusted under 35 U.S.C. 154(b) by 690 days.

(21) Appl. No.: 12/149,632

(22) Filed: May 6, 2008

(65) Prior Publication Data

US 2009/0277785 A1 Nov. 12, 2009

(51) Int. Cl.
*C25B 11/03* (2006.01)
*C25B 9/02* (2006.01)
*C02F 1/461* (2006.01)

(52) U.S. Cl. ..... 204/272; 204/286.1; 204/287; 205/742; 205/758

(58) Field of Classification Search ..... 204/272, 204/286.1, 287, 284; 205/742, 758
See application file for complete search history.

(56) References Cited

U.S. PATENT DOCUMENTS 5,534,120 A * 7/1996 Ando et al. ..... 205/464
5,843,291 A * 12/1998 Eki et al. ..... 204/228.6
5,846,390 A * 12/1998 Eki et al. ..... 204/229.6
5,853,562 A * 12/1998 Eki et al. ..... 205/743
5,858,201 A * 1/1999 Otsuka et al. ..... 205/701
5,865,966 A * 2/1999 Watanabe et al. ..... 204/278.5
6,126,797 A * 10/2000 Sato et al. ..... 204/272
6,267,855 B1 * 7/2001 Watanabe et al. ..... 204/272
6,391,169 B1 * 5/2002 Hara et al. ..... 204/263
2003/0098247 A1 * 5/2003 Nakamura et al. ..... 205/688
2006/0169581 A1 * 8/2006 Grebenyuk et al. ..... 204/272
2010/0270172 A1 * 10/2010 Sano ..... 205/748

* cited by examiner

*Primary Examiner* — Alexa D Neckel
*Assistant Examiner* — Ciel Thomas
(74) *Attorney, Agent, or Firm* — Rosenberg, Klein & Lee

(57) ABSTRACT

An electrolytic bath includes a shell, an upper cover joined on an upper end of the shell, an outer supporting member held in the shell, a hollow cylindrical positive electrode plate held in the outer supporting member, a hollow cylindrical negative electrode plate held in the positive electrode plate, an inner supporting member held in the negative electrode plate, a lower cover joined on a lower end of the shell, and a base member on a bottom of the lower cover; a space exists between the positive and the negative electrode plates; the electrolytic bath has a waste water outlet and a water outlet hole for acid waste water and alkaline water to flow out therethrough respectively; because the electrode plates are hollow cylindrical and completely open, they can't change shape easily, and there is no need for a separating plate, and scale can't form on the electrode plates easily.

5 Claims, 5 Drawing Sheets

COAXIAL SYMMETRICAL COMPLETELY OPEN ELECTROLYTIC BATH

BACKGROUND OF THE INVENTION

1. Field of the Invention

The present invention relates to a coaxial symmetrical completely open electrolytic bath, more particularly one whose positive and negative electrode plates are hollow cylindrical and positioned one within the other in a co-axial manner; there is no need for a separating membrane between the positive and negative electrode plates.

2. Brief Description of the Prior Art

Large amount of pollutant is being produced to harm out environment, and people usually use water filters to remove dangerous contaminants owing to the increasing concern over the quality and safety of tap water. And, water filters are getting popular because more people have begun to realize that purified water product of water filters can be relatively clean and safe to drink.

When water is electrolyzed, hydroxyl ions (OH—) will increase on one side of the electrode plate, and water becomes alkaline. The initial benefits of drinking electrolyzed alkaline water include: decrease in the body's acid content, and getting rid of carcinogenic substances in the body. Therefore, water purifiers equipped with filters and electrolytic baths are getting popular, which can produce healthful purified and alkaline water.

A common electrolytic bath includes a containing member, and positive and negative flat plate-shaped electrodes in the containing member. Furthermore, a membrane is positioned between the positive and the negative flat plate-shaped electrodes to separate alkaline water containing more hydroxyl ions from acid water containing more hydrogen ions. Alkaline water with negative ions will be produced when power is supplied to the positive and the negative electrodes, and water is made to flow over the electrodes.

However, the above electrolytic bath is found to have the following drawbacks: scale and bacteria will accumulate on the separating membrane, and the membrane can't bear very high pressure, and is prone to break; the electrodes have to be supplied with very high voltage current otherwise electrolysis can't happen.

Shown in FIG. 5 is another electrolytic bath 5 without any separating membrane. The electrolytic bath 5 includes a shell 51, and positive and negative flat plate-shaped electrodes 52 and 53 held in the shell 51. And, a cover 55 is joined on the shell 51. The flat plate-shaped electrodes 52 and 53 are usually relatively long, and therefore are prone to bend at the middle portion owing to gravity. Therefore, a separating plate 54 is interposed between the positive and the negative flat plate-shaped electrodes 52 and 53 to prevent the electrodes 52 and 53 from coming into contact with each other to cause short circuit. For the above reason, it takes relatively much labor and time to assemble the electrolytic bath. Furthermore, the separating plate 54 will impede water flow, and in turn sediment of ions will form on the separating plate 54 to cause decrease to service life of the electrolytic bath 5.

Furthermore, such flat-plate shaped electrodes have relatively poor pressure-resistibility while currently existing electrolytic baths can resist high pressure, and therefore are prone to leak.

Therefore, it is a main object of the present invention to provide a coaxial symmetrical completely open electrolytic bath to overcome the above problems.

SUMMARY OF THE INVENTION

A coaxial symmetrical completely open electrolytic bath in accordance with an embodiment of the present invention includes a shell, an upper cover joined on an upper end of the shell, an outer supporting member held in the shell, a hollow cylindrical positive electrode plate held in the outer supporting member, a hollow cylindrical negative-electrode plate held in the positive electrode plate, an inner supporting member held in the negative electrode plate, a lower cover joined on a lower end of the shell, and a base member on a bottom side of the lower cover. Because the electrode plates are hollow cylindrical, they can't change shape easily, and it isn't necessary to install a separating plate between the electrode plates. The electrolytic bath has a waste water outlet and a water outlet hole for acid waste water and alkaline water to flow out therethrough respectively. Moreover, the electrode plates are relatively easy to install. Because the electrode plates are completely open, the electrolytic bath can work relatively efficiently, and scale can't form on the electrode plates easily. Consequently, the electrolytic bath has a long service life. The waste water outlet and the water inlet can be easily and rapidly joined on or separated from a water purifier; in other words, the electrolytic bath is fast to install, and can be easily and rapidly replaced with a new one when it reaches its end of service life.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
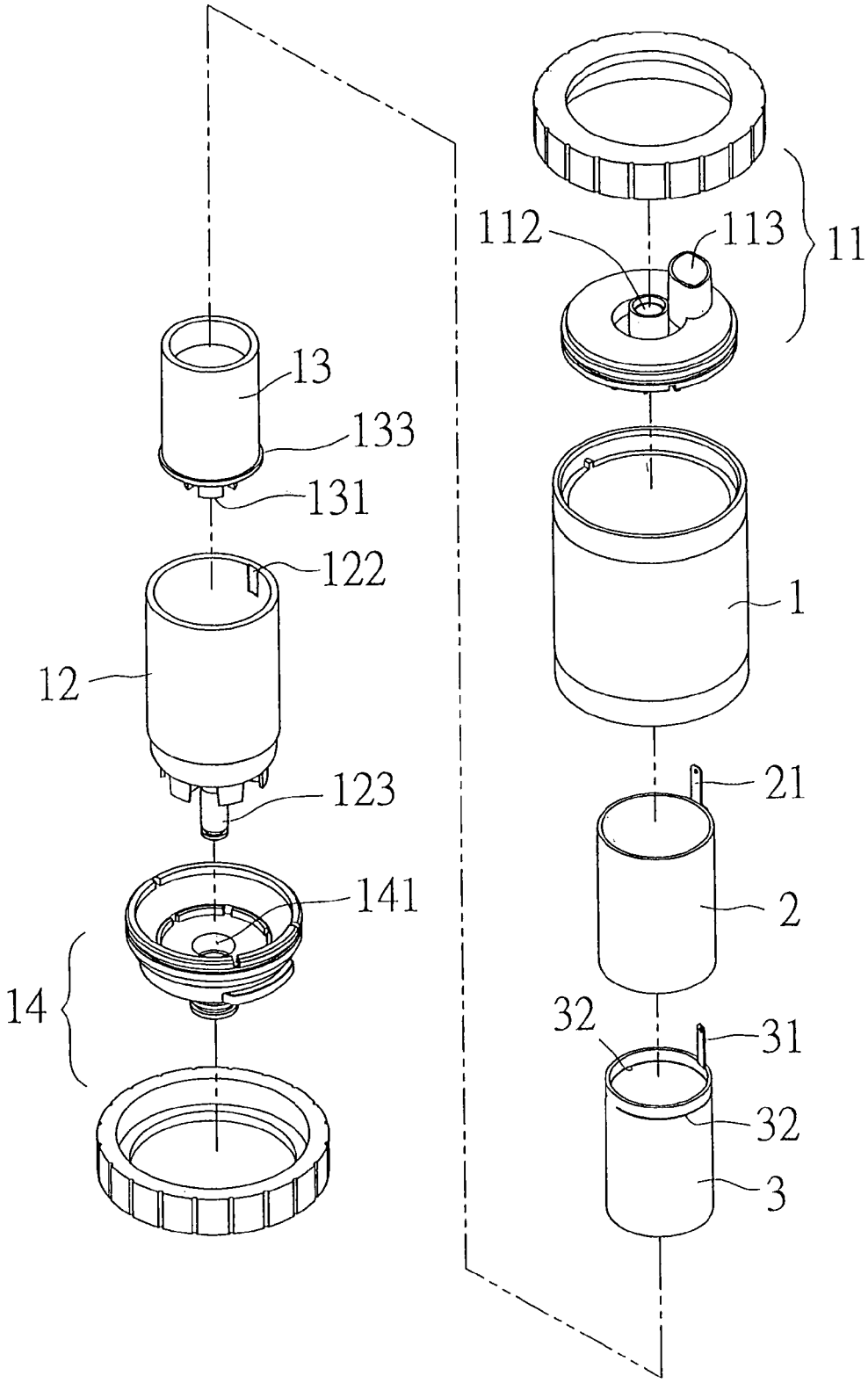
FIG. 1 is an exploded perspective view of the present invention.
Figure 2:
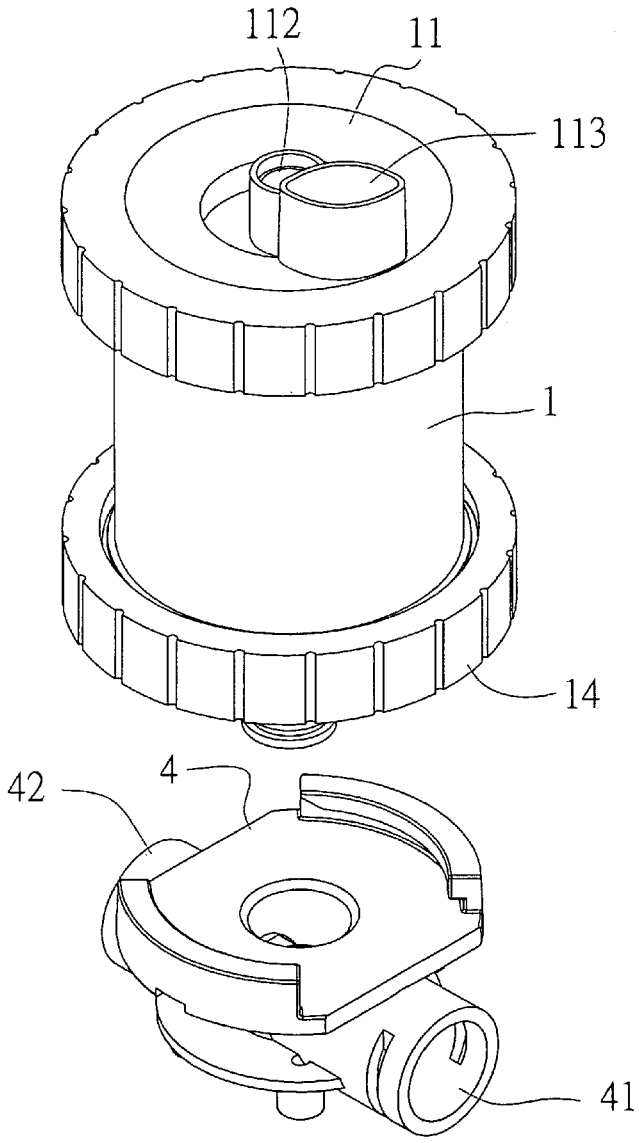
FIG. 2 is a partially exploded perspective view of the present invention.
Figure 3:
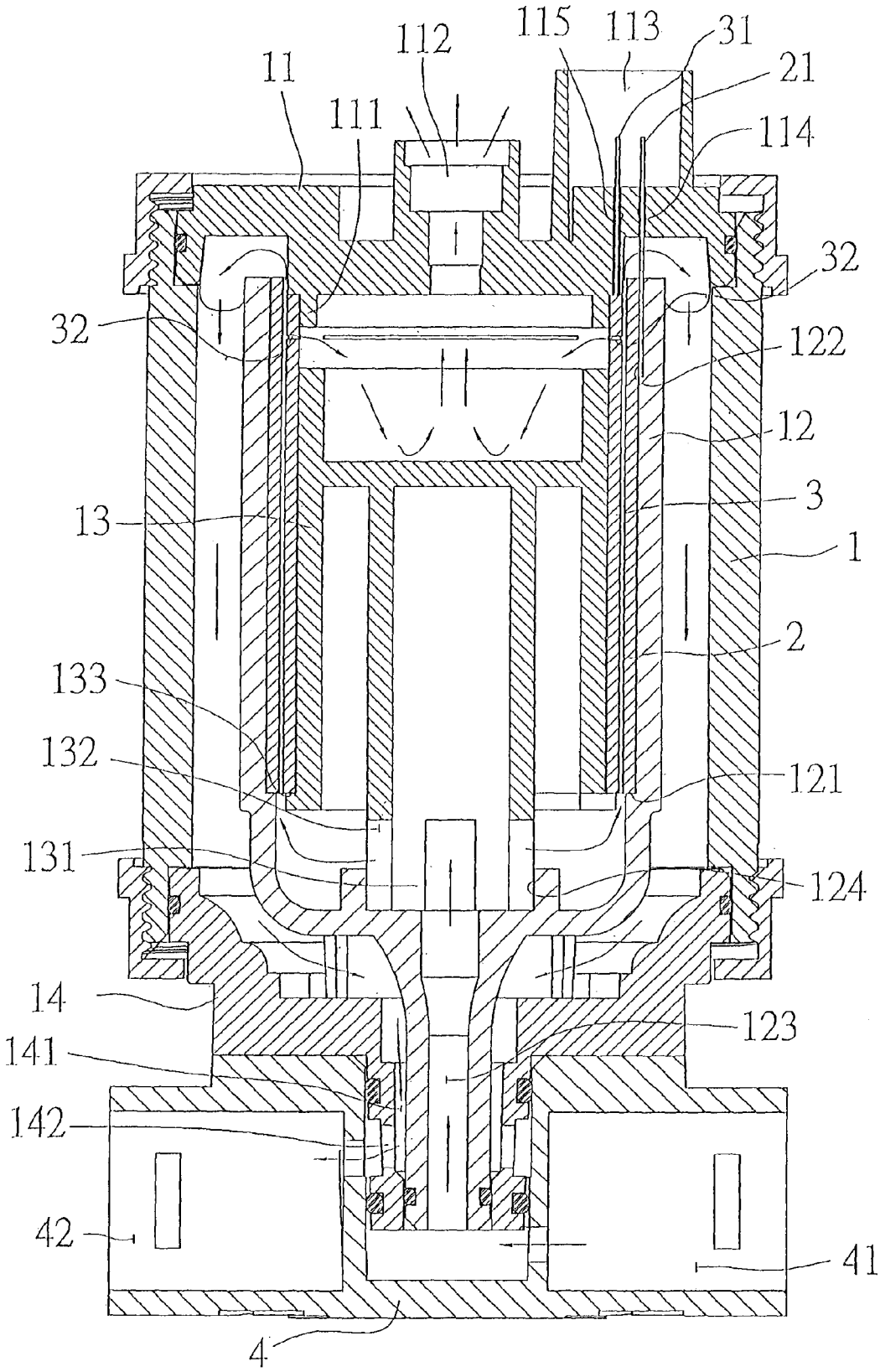
FIG. 3 is a sectional view of the present invention.

Referring to FIGS. 1 and 2, a preferred embodiment of a coaxial symmetrical completely open electrolytic bath of the present invention includes:

a shell 1;

an upper cover 11 joined on an upper end of the shell 1; the upper cover 11 has an annular protrusion 111 on a lower side thereof, and a waste water outlet 112 on an upper side, and a power supply connecting hole 113 on the upper side; the upper cover 11 further has apertures 114 and 115 in the power supply connecting hole 113;

an outer supporting member 12 held in the shell 1; the outer supporting member 12 has a step-shaped portion 121 on an inner side of a lower portion thereof, and a receiving recessed portion 122 on an inner side of an upper end thereof; the outer supporting member 12 has a water inlet 123 protruding from a lower end thereof; the outer supporting member 12 further has an internal hollow propping portion 124 extending inwardly from the water inlet 123;

a positive electrode plate 2 held in the outer supporting member 12 with a lower end thereof being propped on the step-shaped portion 121; the positive electrode plate 2 is in the shape of a hollow cylinder, and has a power supply terminal 21 joined on an upper end thereof; the power supply terminal 21 is received in the receiving recessed portion 122 of the outer supporting member 12, and sticks out through the aperture 114 of the power supply connecting hole 113 of the upper cover 11;

a negative electrode plate 3 held in the positive electrode plate 2 with an upper end thereof being tight around the annular protrusion 111 of the upper cover 11; the negative electrode plate 3 is in the shape of a hollow cylinder; the negative electrode plate 3 has a power supply terminal 31 joined on an upper end thereof; the power supply terminal 31 sticks out through the aperture 115 of the power supply connecting hole 113 of the upper cover 11; the negative electrode plate 3 has a water passage 32 near an upper end thereof;

an inner supporting member 13 held in the negative electrode plate 3; the inner supporting member 13 has a propped protrusion 131 extending from a lower end thereof, which is held in and propped against the hollow propping portion 124 of the outer supporting member 12; the propped protrusion 131 has several holes 132 on a circumferential portion of the bottom propped protrusion 131 thereof; the inner supporting member 13 has a propping protrusion 133 on an outer side thereof, and the negative electrode plate 3 is propped on the propping protrusion 133 of the inner supporting member 13 at a lower end thereof;

a lower cover 14 joined on a lower end of the shell 1; the lower cover 14 has a through hole 141 on a lower end thereof, and the water inlet 123 of the outer supporting member 12 is passed through the through hole 141; the lower cover 14 has a water outlet hole 142 on a lateral side of the lower end;

a base member 4 positioned on the bottom of the lower cover 14; the base member 4 has a water inlet 41, and a water outlet 42; the water inlet 41 of the base member 4 is connected to and forms a water inlet passage together with the water inlet 123 of the outer supporting member 12; the water outlet 42 is connected to and forms a water outlet passage together with the water outlet hole 142 of the lower cover 14.

Figure 4:
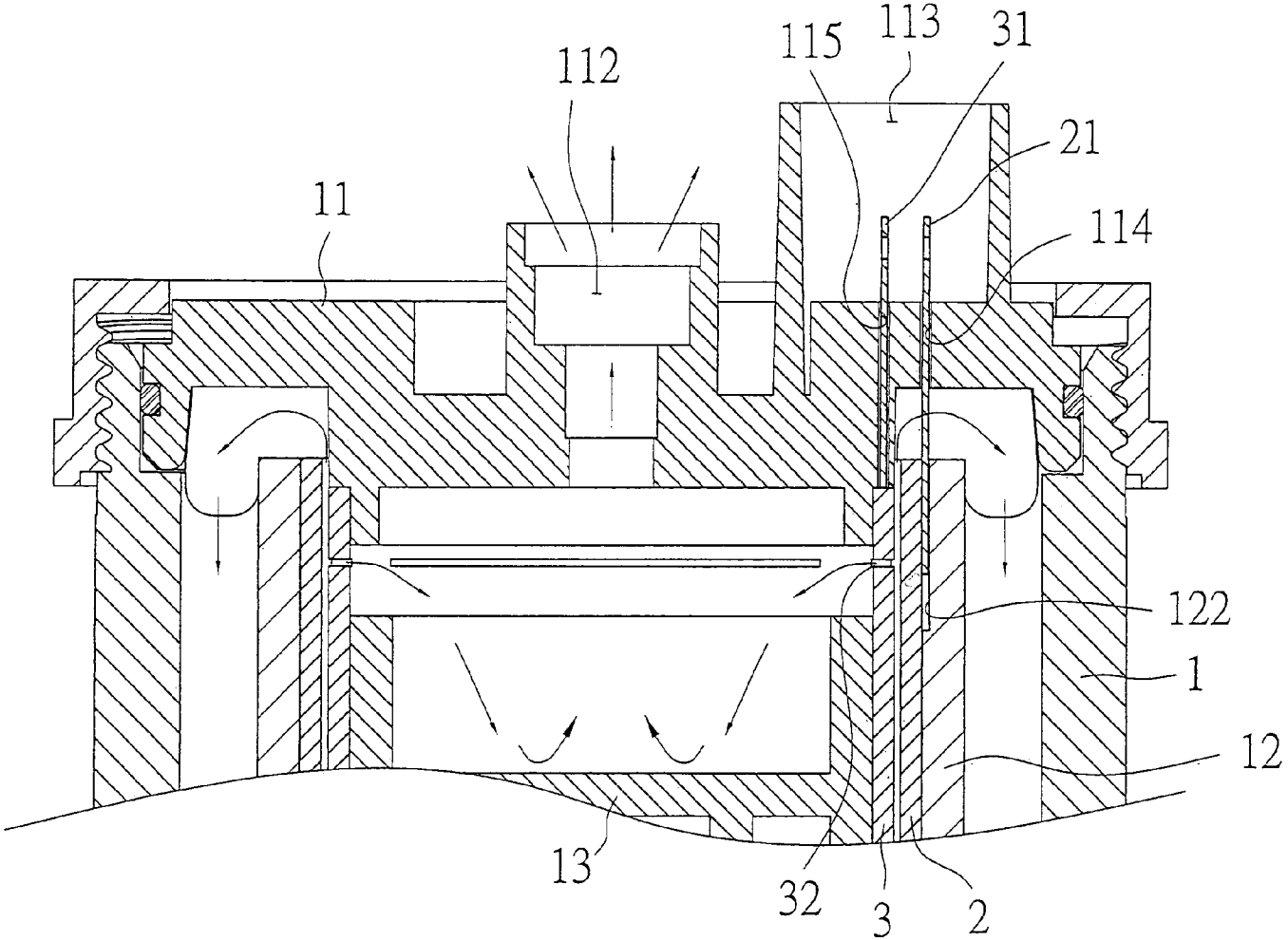
FIG. 4 is a partial sectional view of the present invention.
Figure 5:
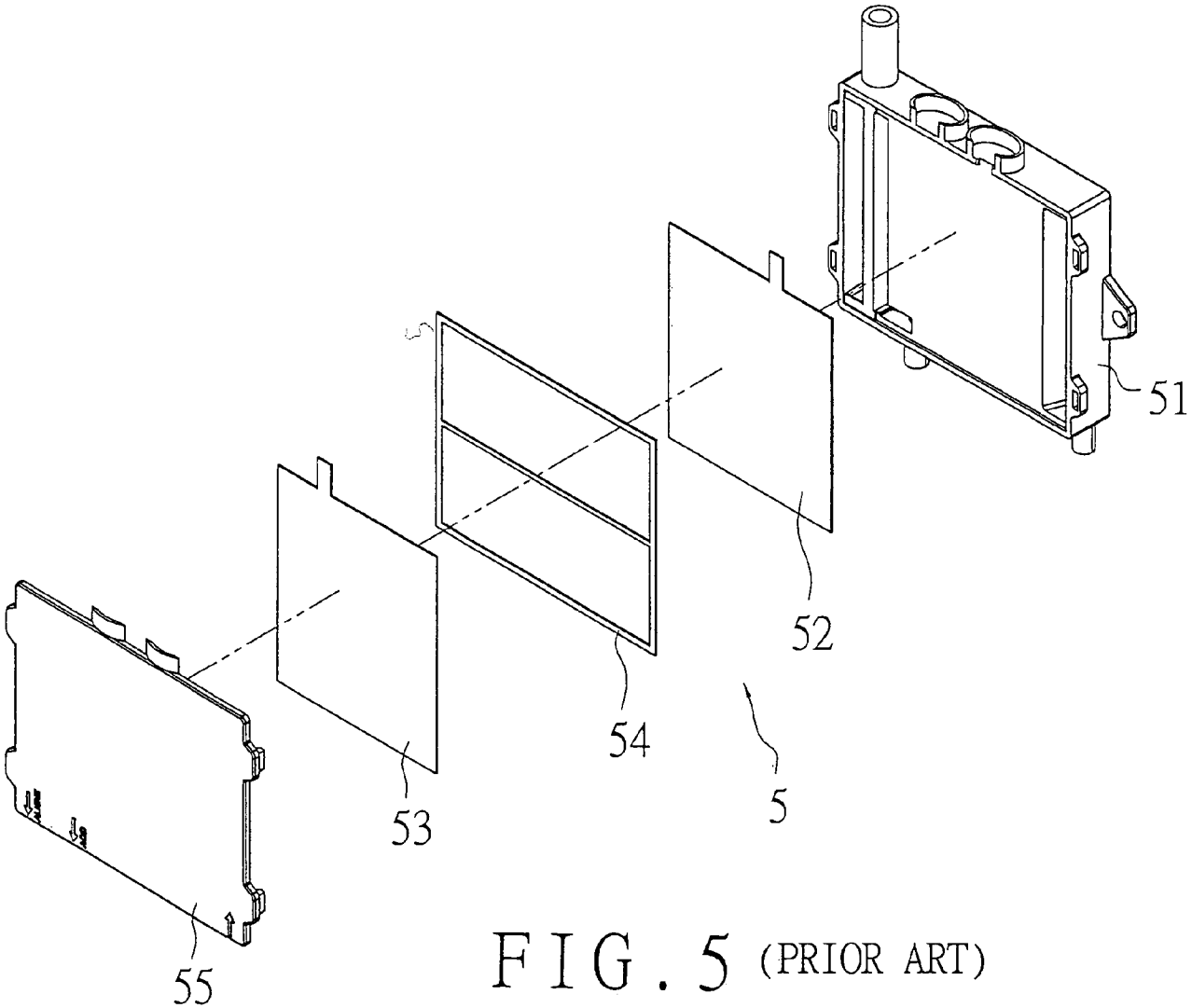
FIG. 5 (PRIOR ART)
FIG. 5 is an exploded perspective view of the prior art.

In use, referring to FIG. 4, a partial sectional view of the electrolytic bath of the present invention, a power supply is connected to the power supply terminals 21 and 31 of the positive and the negative electrode plates 2 and 3 through the power supply connecting hole 113 of the upper cover 11. Next, water is made to flow into the present electrolytic bath through the water inlet 41 of the base member 4; thus, the water will flow into the space between the positive and the negative electrode plates 2 and 3 through the water inlet 123 of the outer supporting member 12 and the holes 132 on the circumferential portion of the propped protrusion 131 of the inner supporting member 13. Therefore, water is electrolyzed. Waste water will be produced from calcium, potassium, magnesium, and sodium positive ions absorbed by the negative electrode plate 3 in the course of electrolysis, and will flow into the negative electrode plate 3 through the water passage 32 near the upper end of the negative electrode plate 3, and next flow out through waste water outlet 112 on the upper side of the upper cover 11. And, alkaline water will flow through into the space between the positive electrode plate 1 and the shell 1, and next flow out through the water outlet hole 142 of the lower cover 14 and the water outlet 42 of the base member 4.

From the above description, it can be seen that the electrolytic bath of the present invention has the following advantages over the prior art:

The positive and the negative electrode plates are hollow cylindrical, and the negative electrode plate is positioned in the positive one in a coaxial manner. Therefore, the electrode plates are relatively strong as compared with those of the prior art, and can't change shape easily; it isn't necessary to install a separating plate between the positive and the negative electrode plates. Second, a space exists between the positive and the negative electrode plates, and the electrolytic bath has a waste water outlet and a water outlet hole for acid waste water and alkaline water to flow out therethrough respectively. For the above reason, the positive and the negative electrode plates are relatively easy to install. Third, the positive and the negative electrode plates are completely open therefore the electrolytic bath can work relatively efficiently, and it is much less possible for scale to form on the electrode plates. Consequently, the present invention has a relatively long service life. Moreover, the waste water outlet and the water inlet of the electrolytic bath of the present invention can be easily and rapidly joined on or separated from a water purifier. In other words, the electrolytic bath can be easily and rapidly replaced with a new one when it reaches its end of service life; the present electrolytic bath is convenient to use.

What is claimed is:

1. A coaxial symmetrical completely open electrolytic bath, comprising a shell; the shell having an upper cover joined on an upper end thereof; the upper cover having a waste water outlet on an upper side; the upper cover having a power supply connecting hole on the upper side; the upper cover having two apertures in the power supply connecting hole thereof;

an outer supporting member held in the shell; the outer supporting member having a first water inlet protruding from a lower end thereof;

a hollow cylindrical positive electrode plate held in the outer supporting member; the positive electrode plate having a first power supply terminal joined on an upper end thereof; the first power supply terminal sticking out through one of the apertures of the power supply connecting hole of the upper cover;

a hollow cylindrical negative electrode plate held in the hollow cylindrical positive electrode plate; the negative electrode plate having a second power supply terminal joined on an upper end thereof, which sticks out through other one of the apertures of the power supply connecting hole of the upper cover; the negative electrode plate having a water passage near an upper end thereof;

an inner supporting member held in the negative electrode plate;

the inner supporting member having a plurality of holes on a lower end thereof;

a lower cover joined on a lower end of the shell; the lower cover having a through hole on a lower end thereof, through which the first water inlet of the outer supporting member is passed; the lower cover having a water outlet hole on a lateral side of the lower end; and a base member positioned on the lower end of the lower cover; the base member having a second water inlet, which is connected to and forms a water inlet passage together with the first water inlet of the outer supporting member; the base member having a water outlet, which is connected to and forms a water outlet passage together with the water outlet hole of the lower cover.

2. The coaxial symmetrical completely open electrolytic bath as claimed in claim 1, wherein the upper cover has an annular protrusion on a lower side thereof, and the inner supporting member has a propping protrusion on an outer side thereof, and the negative electrode plate is held in position with the annular protrusion of the upper cover and the propping protrusion of the inner supporting member at upper and lower ends thereof.

3. The coaxial symmetrical completely open electrolytic bath as claimed in claim 1, wherein the outer supporting member has a step-shaped portion on an inner side of a lower portion thereof, and the positive electrode plate is propped on the step-shaped portion of the outer supporting member at a lower end thereof.

4. The coaxial symmetrical completely open electrolytic bath as claimed in claim 1, wherein the outer supporting member has a receiving recessed portion on an inner side of an upper end thereof, and the second power supply terminal of the positive electrode plate is received in the receiving recessed portion of the outer supporting member.

5. The coaxial symmetrical completely open electrolytic bath as claimed in claim 1, wherein the outer supporting member has an internal hollow propping portion extending inwardly from the water inlet thereof, and the inner supporting member has a propped protrusion extending from a lower end thereof, which is held in and propped against the hollow propping portion of the outer supporting member.

* * * * *